United States Patent [19]

Ostrowsky

[11] 3,968,880

[45] July 13, 1976

[54] PLASTIC CONTAINER

[75] Inventor: Efrem M. Ostrowsky, Highland Park, Ill.

[73] Assignee: VCA Corporation, Baton Rouge, La.

[22] Filed: Aug. 28, 1975

[21] Appl. No.: 608,545

[52] U.S. Cl. ..... 206/540; 220/281; 220/306; 220/339

[51] Int. Cl.[2] ..... B65D 43/04; B65D 43/14; B65D 85/56

[58] Field of Search ..... 206/1.5, 540; 215/201, 215/209, 224–225; 220/281–283, 306–307, .339

[56] References Cited

UNITED STATES PATENTS

| | | | |
|---|---|---|---|
| 2,958,439 | 11/1960 | Yochem | 220/339 |
| 3,434,614 | 3/1969 | Moller | 215/224 |
| 3,758,000 | 9/1973 | Mack | 220/306 X |
| 3,907,103 | 9/1975 | Shaw | 206/540 X |

*Primary Examiner*—Steven E. Lipman
*Attorney, Agent, or Firm*—Donald L. Johnson; John F. Sieberth; Edgar E. Spielman, Jr.

[57] ABSTRACT

A "childproof" container having reproducible opening and closing characteristics is disclosed. The container is an integrally formed, one-piece, plastic container having a bottom section and an overlying top section hinged to the bottom section. A latching assembly which prevents undesirable "relock" when the container is being opened is featured. The portion of the locking assembly which is carried by the bottom section comprises an upwardly projecting latching lug which is thicker at its distal end than at its proximate end. The top section carries the other portion of the locking assembly which features a downwardly projecting latching protuberance on its top wall and an inwardly projecting latching protuberance on its front wall. The two protuberances are spaced apart so that the distance between them is less than the distal thickness of the latching lug carried by the bottom section. In this manner the latching lug will snap into place between the two latching protuberances with the application of a closing pressure on the top and bottom sections. Without this closing pressure however, the relocking of the container is not possible.

15 Claims, 12 Drawing Figures

PLASTIC CONTAINER

BACKGROUND OF THE INVENTION

Recent FDA regulations will require that aspirin tablets and a number of items be packaged in special containers which have "childproof" features. The containers must not be openable by children under a certain age in a certain number of attempts to open the containers. Satisfactory closures have been developed for bottle-type containers for aspirin and prescription drugs and other items which may be potentially dangerous to children. However, difficulty has been encountered in producing a satisfactory rectangular, two-piece, hinged, conventional container for packaging tablets. The problem has primarily been one of developing a container which has a consistent opening pressure, such that only pressure applied by an adult can open the container.

The utilization of conventional metallic containers is unsatisfactory as the latches provided, usually a projection on the lower section and an indentation on the upper section into which the lower indentation fits, are not selective enough so that the container cannot be opened by a child. Adapting the metal container for "childproof" latches is economically impractical as the metal from which the containers are made is not suitable for such complex latches.

Plastic containers offer an attractive alternative in providing a "childproof" container. Complex latches are possible without overly burdensome cost and plastic materials are generally in good supply. Suitable plastics are those such as polypropylene, polyethylene, vinyl chloride, etc. Generally these plastic containers will have a bottom section, a top section overlying the bottom section and hinged to the bottom section. The two sections are latched together by a latching assembly which generally includes, a protuberance projecting from the outside front wall surface of the bottom section and a recess in the inside wall of the front portion of the top section. The recess is designed to accommodate the protuberance. Pressure on the back of the container releases the latch for opening.

As advantageous as these types plastic containers have proven to be, they still suffer from one annoying problem which relates to the tendency of most plastics to "coldset". "Coldsetting" is defined as the characteristic of plastic which causes the plastic to be biased to a position in which the plastic has been held for a period of time. In the case of containers, since the containers are usually stored in the closed position, "coldset" biases the container to remain closed even after the latching mechanism has been actuated to open the container. Thus when the user presses down on the container at its rearward corners, the latches unlatch but due to the "coldset" of the hinge holding the upper section to the lower section, the latches will tend to relatch.

Therefore it is an object of this invention to provide a plastic "childproof" container having latches holding the container closed which are capable of remaining in the open mode irrespective of whether or not the resilient hinge has a "coldset" biasing the container to the closed position.

THE INVENTION

This invention relates to an improvement in an integrally formed, one-piece plastic container having a bottom section and an overlying top section hinged to the bottom section; the bottom section being characterized in that it has a planar bottom wall, two opposed, upturned sidewalls, an upturned back wall, and an upturned front wall, all of which are integrally formed and connected to each other, the upturned front wall carrying top latching lug means; and the top section being characterized in that it has a planar top wall, two opposed downturned sidewalls, a downturned front wall, all of which are integrally formed and connected to each other and a downturned back wall integrally formed and connected to the top wall, the downturned front wall carrying bottom latching lug means for engaging the lug means on the upturned front wall of the bottom section to latch the top section to the bottom section; which improvement comprises: the upturned front wall having an outwardly and upwardly projecting latching lug, the latching lug having an upper and lower surface which diverge one from the other; and the downturned front wall having on its inside surface an inwardly projecting lower latching protuberance and the top wall having on its inside surface a downwardly projecting upper latching protuberance, at least a part of the lower latching protuberance and the upper latching protuberances being in close proximity to the lower surface and the upper surface respectively, so that the distance between these parts is less than the distance between the surfaces at their distal ends.

As can be appreciated from the foregoing, by having the distance between the latching protuberances less than the distance between the surfaces of the latching lug at their distal ends, locking of the latching lug between the latching protuberances can only be achieved by the utilization of closing force upon the front of the container.

Relocking is obviated due to the difference between the distances even though the container is urged to be in a closed mode by a "coldsetting" of the hinge in the closed mode. Since most plastic containers which are kept in the closed position for any period of time will suffer a closed biased "coldset" in the hinge, the latching assembly of this invention is an invaluable contribution to the success of providing the art with integrally formed, one-piece plastic containers which are essentially "childproof".

These and other features of the invention contributing satisfaction in use and economy in manufacture will be more fully understood from the following description of a preferred embodiment of the invention when taken in connection with the accompanying drawings, wherein identical numerals refer to identical parts and in which.

Figure 1:
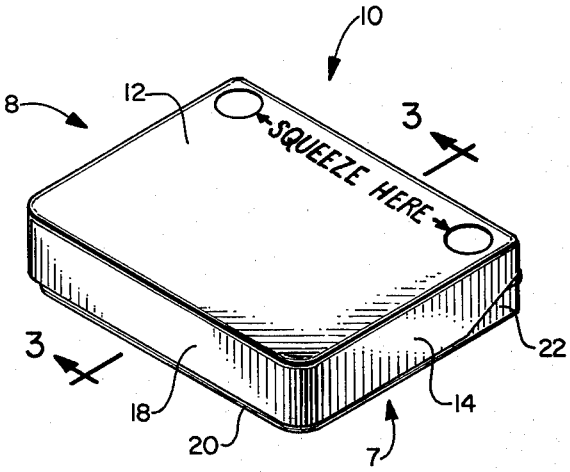
FIG. 1 is a perspective, elevational view of a container of this invention showing the container in a closed position.
Figure 2:
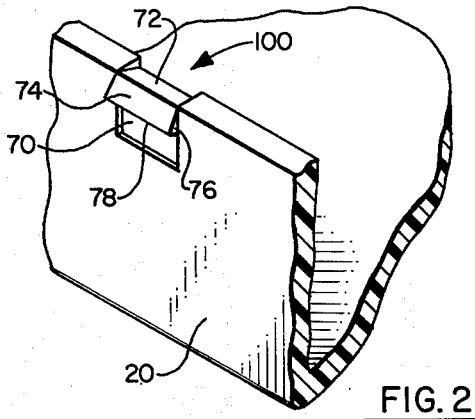
FIG. 2 is an enlarged, perspective, elevational view showing the latching lug on the lower section of the container shown in FIG. 1.

Referring now to FIGS. 1, 3–6 and 8, a container of the present invention is characterized in that it is made from integrally formed, semi-flexible plastic material. The container, designated generally by the reference numeral 10, is composed of two sections, a bottom section, designated generally by the numeral 7 and a top section, designated generally by the numeral 8. Bottom section 7 includes a generally rectangular planar bottom wall 16 which is integrally connected to an upturned front wall 20. Front wall 20 and bottom wall 16 are integrally formed with and connected to opposed, upturned sidewalls 24 and 22 and to rear wall 28. Rear wall 28 projects upward at a slight obtuse angle from bottom wall 16. Rear wall 28 is slightly less than one-half of the height of the front wall and sidewalls of the bottom section. The bottom section sidewalls and front wall and the top section sidewalls and front wall are preferably of equal height. By these walls being of equal height, the container can then be easily handled with maximum efficiency for printing, filling, and closing automatically. Also, it provides minimum exposed bottom side and front walls in the closed position for a child to force open the container.

Top section 8 of the container includes a generally planar top wall 12 which is integrally formed and connected to a downturned front wall 18. The top wall 12 and front wall 18 are integrally formed with and connected to two opposed sidewalls 14 and 15. Top wall 12 has integrally formed therewith a downwardly and rearwardly projecting rear wall 26. Top wall 12 and rear wall 26 form an obtuse angle with each other. Preferred angles are those within the range of from about 100° to about 135°. A highly preferred range is from about 115° to about 125°. In this embodiment, by having top wall 12 and rear wall 26 forming an obtuse angle and by having rear wall 26 not connected to sidewalls 14 and 15, downward pressure upon the corners of the container results in a forward motion of top section 8 which will unlatch the latches as hereinafter described. It is to be understood of course that other container configurations and designs may be utilized to obtain the necessary motion for unlatching of the latches.

Figure 7:
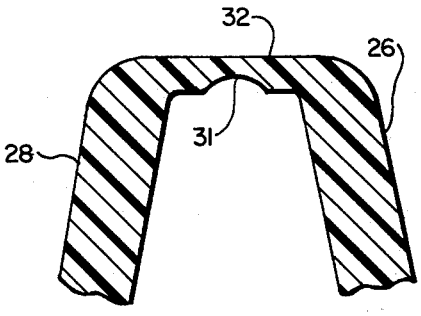
FIG. 7 is an enlarged view of the hinge and attached rear wall shown in FIG. 5.

Rear wall 26 and 28 are joined by an integrally formed living hinge section 32. As seen more clearly in FIG. 7, hinge section 32 has a wall thickness which is substantially thinner than the wall thickness of the rear walls 28 and 26. Preferably the wall thickness of the hinge section is about one-half or less than the thickness of rear walls 26 and 28. The longitudinally extending groove 31 (which may be in any particular form, but is shown in the drawings as a semicircular groove) extends the full length of the hinged section. This groove provides a weakening of the major flexing portion of hinge section 32 to facilitate easy flexure of hinge section 32 when opening and closing the container. Hinge section 32 has a molded end bias so that it is constantly exerting an upward or opening pressure on top section 8. It is when this bias is overcome by a "coldset" that the molded bias of the hinge is destroyed and that the latch assembly of this invention is so useful. It is to be understood that hinge section 32 in the embodiment illustrated is not the only type of resilient, flexible hinge which can be used in conjunction with the container of this invention. Hinge section 32 need not be continuous as illustrated but rather may be sectioned.

Figure 3:
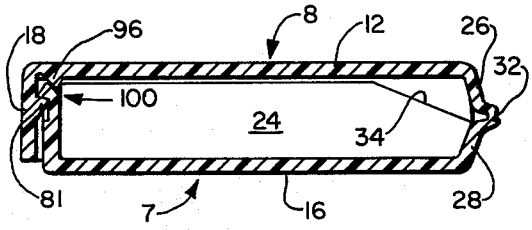
FIG. 3 is a sectional view taken along section lines 3—3 of FIG. 1.
Figure 4:
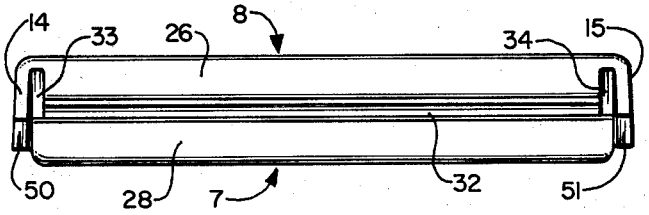
FIG. 4 is a rear view of the container shown in FIG. 1.
Figure 5:
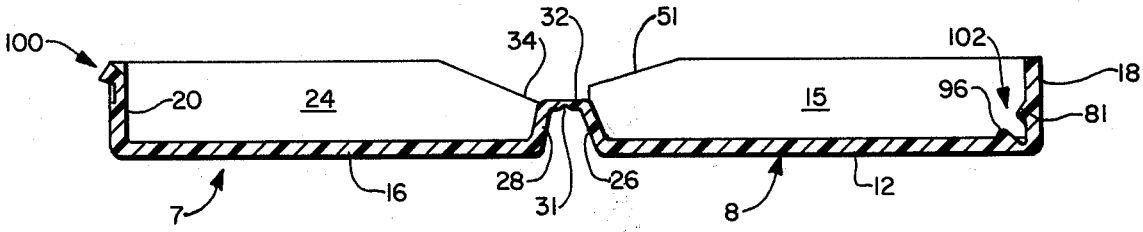
FIG. 5 is a sectional view taken along section lines 5—5 of FIG. 8.
Figure 6:
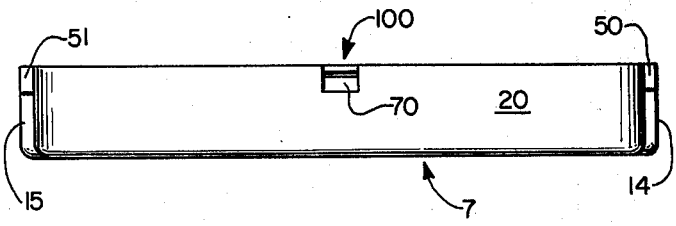
FIG. 6 is a front view of the container shown in FIG. 1 in the open position.
Figure 8:
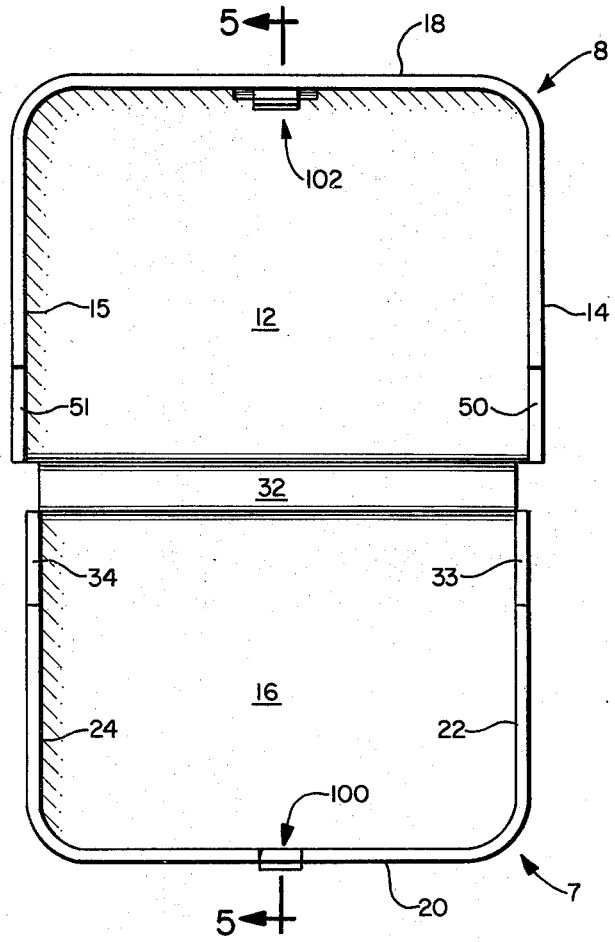
FIG. 8 is a top plan view of the container of FIG. 1 in the open position.
Figure 9:
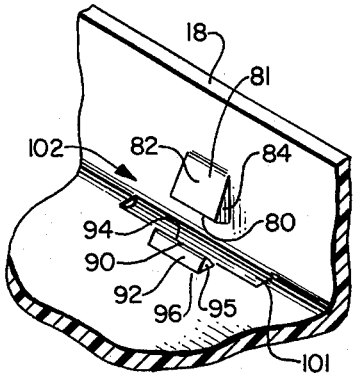
FIG. 9 is an enlarged, perspective, elevational view showing the protuberances carried by the top section of the container shown in FIG. 1.

Referring now to FIGS. 3, 5 and 8, it can be seen that bottom section 7 and top section 8 of the container have their sidewalls 24 and 22 and 15 and 14 respectively provided with rearwardly tapered sections 51 and 50 for sidewalls 15 and 14 and tapered sections 34 and 33 for sidewalls 24 and 22. Tapered sections 34 and 33 serve to provide a pivotal point upon which top section 12 will pivot upon application of pressure thereon. The pivot point is formed by the intersection of tapered sections 34 and 33 with the remaining portion of the top edges of sidewalls 24 and 22. When top section 8 is pressed downwardly top wall 12 contacts the above-described pivot point causing the front portion of top section 8 to pivot upwardly in response to the downward pressure. This upward motion of the front portion of top section 8 is useful in aiding the disengagement of the two sections when unlatching is performed.

Tapered sections 51 and 50 provide clearance so that the rear corners of top section 8 do not press into the fingers of the user while pressing on the top section. Also there will be no interference with the action of the container of this invention when it is opened by pressing down on the corners of top section 8 when the container is resting upon a table.

Figure 10:
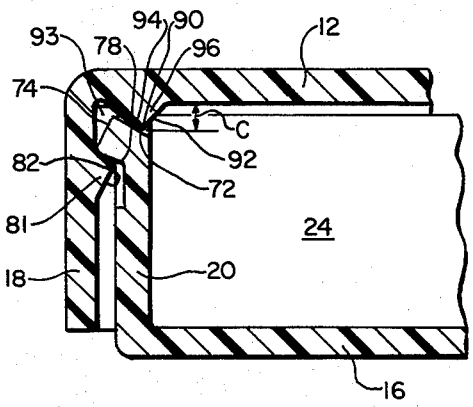
FIG. 10 is an enlarged view of the latching lug and latching protuberances of a container of this invention in the latched position.
Figure 11:
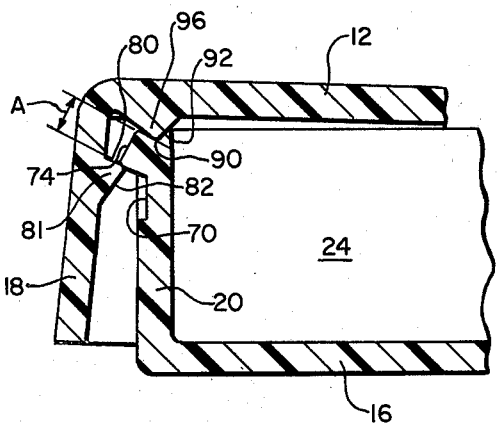
FIG. 11 is an enlarged view of the latching lug and latching protuberances of a container of this invention in the opening phase.
Figure 12:
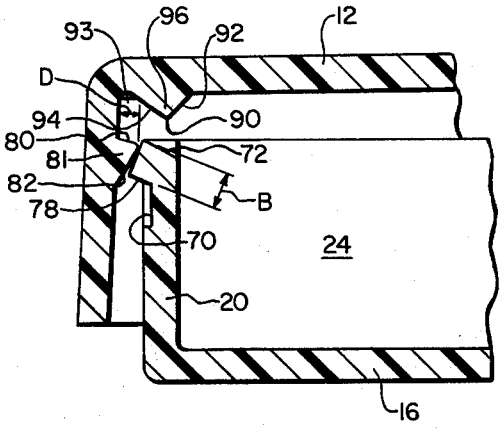
FIG. 12 is an enlarged view of the latching lug and latching protuberances of a container of this invention in the unlatched position.

Maintaining top section 8 and bottom section 7 in a locked relationship is a latching assembly which possesses a no-relatch capability. From FIGS. 2, 3, 5, 6 and 8–12 it can be seen that a latching assembly of this invention has a latching lug, generally designated by the numeral 100, and cooperating latching protuberances generally designated by the numeral 102. Latching lug 100 depends from upturned front wall 20 and extends outwardly and upwardly from the outside surface thereof. Latching lug 100 has a lower planar surface 78 and an upper planar surface 72. As can be seen in FIGS. 10–12, these two surfaces diverge in an outward direction thus giving latching lug 100 a greater width at its distal end than at its proximate end. Connecting lower planar surface 78 and upper planar surface 72 is end surface 74. Completing the configuration of latching lug 100 are two side surfaces, one of which is numbered 76 and the other (which is not shown but is identical to side surface 76). Even though the latching lug shown in the drawings has a generally rectangular configuration, it is to be understood that other configurations may be utilized which will serve the same purpose as the rectangular configuration shown. The only requirement of any configuration is that the lug must have a width which is larger at its distal end than at its proximate end. The necessity of such a relationship in width will be hereinafter described. Immediately below latching lug 100 is recess 70 which is to aid in accommodation of side protuberance 81 described below.

The other portion of the latching assembly is made up of latching protuberance 102 which are carried by top section 8. One of the protuberances, side protuberance 81, is carried by downturned front wall 18. The other protuberance, top protuberance 96 is carried by top wall 12. As can be seen in FIG. 10, in the closed position the distance between upper protuberance 96 and side protuberance 81 is less than the distal width of latching lug 100. It should also be noted that the recessed space 93 between the two protuberances and downturned front wall 18 and top wall 12 is sufficiently large to accommodate the larger distal end of latching lug 100 without placing downturned front wall 18 or top wall 12 in a stressed position. Aiding in providing space 93 is recess 101. Preferred configurations for latching protuberance 102 are depicted in the drawings. Upper protuberance 96 is generally triangular in cross-section as can be seen in FIGS. 10–12. Upper protuberance 96 has rearward facing surface 92 and frontward facing surface 94 which meet to form an arcuate surface 90. It is preferred that these two surfaces meet to form an arcuate surface so that in operation this smooth or arcuate surface can move freely upon upper surface 72 of latching lug 100. Completing upper protuberance 96 are two side surfaces, one of which is labeled 95 and the other which is identical thereto but which is not shown.

Side protuberance 81 also has a triangular shape in cross-section as can be seen in FIGS. 10–12. Side protuberance 81 has upwardly extending camming surface 82 which extends from the inside surface of downturned front wall 18 until it reaches an intersection with upper surface 80. Preferably upper surface 80 closely parallels lower planar surface 78 by latching lug 100 when the container is in the latched position. Side protuberance 81 has side surfaces which complete its shape, one of which is side surface 84 and the other which is not shown but which is identical thereto.

As before mentioned, the only requirement of the latching assembly of this invention is that the latching lug be greater in width at its distal end than at its proximate end and that the latching protuberances be spaced apart one from the other such that the distance between them is less than the greater distal width of the latching lug. As can be appreciated therefore, many different dimensions and configurations for the latching lug and latching protuberances are possible without departing from the principles of this invention. By way of example, the latching assembly used in a standard sized tablet container depicted in the drawings features a latching lug which can have a width from about 0.040 inch to about 0.065 inch at A and a width of from about 0.045 inch to about 0.070 inch at B. The angle at which upper surface 72 of latching lug 100 forms with the horizon can range from about 15° to about 45°, while the angle with which the lower surface 78 forms with the horizon can range from about 0° to about 30°. The distance C which upper protuberance 96 extends down from the inside of top wall 12 can range from about 0.015 inch to about 0.100 inch. The distance D with which side protuberance 81 extends from the inside of downturned sidewall 18 can range from about 0.020 inch to about 0.100 inch. Camming surface 82 of side protuberance 81 is preferably substantially parallel with end surface 74 of latching lug 100.

In operation, the container of this invention is the paragon of simplicity and reliableness. With the container in the closed position, the user merely has to apply a downward pressure at the rear corners of the top section (at the SQUEEZE HERE marks) to open the container. When the downward pressure is applied at the rearward corners of the container, the top wall 12 is forced downward at the rear and makes contact with the pivots formed by tapered sections 34 and 33. As before mentioned, these pivot points will cause the front portion of top section 8 to be pulled in an upward direction. Also downward pressure will cause top section 8 to move forward due to the obtuse angle formed by downward rear wall 26 and top wall 12. This outward and upward force on the latch assembly will cause latch protuberance 96 to move along the upper surface of latching lug 100 and side protuberance 81 to move along lower surface 78 of latching lug 100. As the two protuberances move to a position where the distance between them is less than the width of latching lug 100 deformation of the juncture between top wall 12 and downturned front wall 18 will occur to allow the protuberance to fit over the wider distal end of latching lug 100. This deformation is shown in FIG. 11. After protuberance 96 and 81 have cleared the larger end of latching lug 100, as shown in FIG. 12, top wall 12 and downturned front wall 18 will assume a relaxed position as shown in FIG. 12. As can be seen in FIG. 12, the relatching of the container is impossible without applying a downward force on front portion of top section 8. This is so because the distance between protuberances 81 and 96 is smaller than the width of the distal end of latching lug 100.

To close the container the user need only to apply downward pressure on the front portion of top section 8. This downward pressure will cause camming surface 81 to ride upon end surface 74 of latching lug 100. By camming surface 81 so riding, the juncture of top wall 12 and downturned front wall 82 will be stressed to cause divergence of top wall 12 and front wall 82 thus increasing the distance between protuberances 81 and 96. Once the distance between the protuberances is sufficiently large to allow the larger distal end of latching lug 100 to fit therebetween, latching lug 100 will snap into recess 93. After this snapping action has been accomplished downturned front wall 18 and top wall 12 will return to the relaxed position. As can be appreciated in the closed mode, no part of the latch is under stress.

This is an important feature as there is no problem with the "coldsetting" phenomena affecting the reliability of the latch.

The container of the present invention may be fabricated from any suitable, flexible, thermoplastic material. Suitable thermoplastic materials are high, medium and low density polyethylene, polypropylene, copolymers of ethylene and propylene with other monomers, plasticized PVC and copolymers of vinyl chloride with other monomers. The container of the present invention may be easily formed by injection molding or by thermoforming of suitable plastic material. The container is suitable for packaging medicants in that it can be designed to provide a "childproof" container.

What is claimed is:

1. In an integrally formed, one-piece plastic container having a bottom section and an overlying top section hinged to said bottom section wherein:

said bottom section is characterized in that it has a planar bottom wall, two opposed, upturned sidewalls, an upturned back wall, and an upturned front wall, all of which are integrally formed and connected to each other; and said top section is characterized in that it has a planar top wall, two opposed, downturned sidewalls, a downturned front wall, all of which are integrally formed and connected to each other and a downturned back wall integrally formed and connected to said top wall;

the improvement which comprises: said upturned front wall having an outwardly and upwardly projecting latching lug, said latching lug having an upper and lower surface which diverge one from the other; and said downturned front wall having on its inside surface an inwardly projecting lower latching protuberance and said top wall having on its inside surface a downwardly projecting upper latching protuberance, at least a part of said lower latching protuberance and said upper latching protuberance being in close proximity to said lower surface and said upper surface respectively, so that the distance between said parts is less than the distance between said surfaces at their distal ends.

2. The container of claim 1 wherein said lower surface is a planar surface.

3. The container of claim 1 wherein said container is made of material from the group consisting of polyethylene and polypropylene.

4. The container of claim 1 wherein said container has at least two latching lugs and an upper and a lower protuberance for cooperating with each latching lug.

5. The container of claim 1 wherein said downturned back wall forms an obtuse angle with said planar top wall.

6. The container of claim 1 wherein said upper surface is a planar surface.

7. The container of claim 6 wherein said upper latching protuberance has an arcuate surface which is in close proximity to said upper planar surface.

8. The container of claim 1 wherein said upper surface and said lower surface are planar surfaces and said upper surface forms an angle of from about 15° to about 45° with the horizontal plane and said lower surface forms an angle of from about 0° to about 30° with the horizontal plane.

9. The container of claim 8 wherein said upper planar surface and said lower planar surface are connected by a third planar surface which forms the distal end of said latching lug.

10. The container of claim 8 wherein said lower latching protuberance has a first planar surface which substantially parallels and is in close proximity to said lower planar surface.

11. The container of claim 10 wherein said lower latching protuberance has a second planar surface which extends from said first planar surface downward to the inside surface of said downturned front wall.

12. The container of claim 11 wherein said upper planar surface and said lower planar surface are connected by a third planar surface which forms the distal end of said latching lug and said third planar surface is substantially parallel to said second planar surface of said lower latching protuberance.

13. The container of claim 1 wherein said upturned sidewalls each provide a pivot point about which said planar top wall pivots upon application of downward pressure on the rear portion of said planar top wall.

14. The container of claim 13 wherein said downturned back wall forms an obtuse angle with said planar top wall.

15. The container of claim 12 wherein said sidewalls have a horizontal section and a downwardly tapering section and said pivot point is formed by the intersection of these two sections.

* * * * *

UNITED STATES PATENT OFFICE

CERTIFICATE OF CORRECTION

PATENT NO. : 3,968,880

DATED : July 13, 1976

INVENTOR(S) : Efrem M. Ostrowsky

It is certified that error appears in the above-identified patent and that said Letters Patent are hereby corrected as shown below:

Col. 8, line 33 reads claim 12, should read claim 13.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*